US006922900B1

(12) United States Patent
Henry

(10) Patent No.: US 6,922,900 B1
(45) Date of Patent: Aug. 2, 2005

(54) BOW SIGHT MOUNT

(76) Inventor: Donald J. Henry, Box 28, Rte. 220, New Albany, PA (US) 18833

( * ) Notice: Subject to any disclaimer, the term of this patent is extended or adjusted under 35 U.S.C. 154(b) by 0 days.

(21) Appl. No.: 10/707,832

(22) Filed: Jan. 15, 2004

Related U.S. Application Data

(60) Provisional application No. 60/319,893, filed on Jan. 22, 2003.

(51) Int. Cl.[7] ..... F41G 1/467
(52) U.S. Cl. ..... 33/265; 124/87
(58) Field of Search ..... 33/265; 124/87

(56) References Cited

U.S. PATENT DOCUMENTS 5,657,740 A * 8/1997 Slates et al. ..... 124/87
RE36,266 E * 8/1999 Gibbs ..... 33/265
5,941,226 A * 8/1999 Marietta ..... 124/87
6,401,347 B1 * 6/2002 Slates ..... 33/265
6,430,822 B1 * 8/2002 Slates ..... 33/265
6,477,779 B1 * 11/2002 Slates ..... 33/265
6,609,306 B2 * 8/2003 Johnson et al. ..... 33/265
6,701,632 B2 * 3/2004 Henry ..... 33/265

* cited by examiner

*Primary Examiner*—Christopher W. Fulton
*Assistant Examiner*—Madeline Gonzalez
(74) *Attorney, Agent, or Firm*—John J. Elnitski, Jr.

(57) ABSTRACT

A bow sight mount including a mounting plate, rail, adjustment bolt, sight platform and tightening assembly. The mounting plate includes a sight end and a mounting end. The rail extends along the sight end. The adjustment bolt is retained by the sight end. The sight platform includes a slide section for connection to the sight end and a sight section adapted for connection of a bow sight. The slide section includes a rail groove to slidably mount the slide sight platform to the rail of the sight end. The slide section includes a threaded hole to receive threads of the adjustment bolt. The slide section includes a clamping slot which splits the rail groove to allow clamping of sides of the rail groove against the rail. The tightening assembly is for closing and clamping the sides of the rail groove against the rail.

21 Claims, 5 Drawing Sheets

BOW SIGHT MOUNT

CROSS REFERENCE TO RELATED APPLICATIONS

This application claims the benefit of and incorporates by reference U.S. Provisional Application No. 60/319,893 filed Jan. 22, 2003.

BACKGROUND OF INVENTION

The present invention generally relates to bow sights used on archery bows for sighting of a target. More specifically, the present invention relates to an adjustable mount to be mounted on a bow which allows adjustment of a sight attached to the adjustable mount.

There are many bow sight mounts on the market today which are adjustable. The problem with most adjustable bow sight mounts are that the sight is not securely locked in position. What is needed is a bow sight mount with a locking system to secure the sight on the bow sight mount in position after adjustment.

The object of the present invention is to provide a bow sight mount which locks a sight in position after final adjustment.

SUMMARY OF INVENTION

A bow sight mount including a mounting plate, rail, adjustment bolt, sight platform and tightening assembly. The mounting plate includes a sight end and a mounting end. The rail extends along the sight end. The adjustment bolt is retained by the sight end. The sight platform includes a slide section for connection to the sight end and a sight section adapted for connection of a bow sight. The slide section includes a rail groove to slidably mount the slide sight platform to the rail of the sight end. The slide section includes a threaded hole to receive threads of the adjustment bolt. The slide section includes a clamping slot which splits the rail groove to allow clamping of sides of the rail groove against the rail. The tightening assembly is for closing and clamping the sides of the rail groove against the rail.

DETAILED DESCRIPTION

Figure 1:
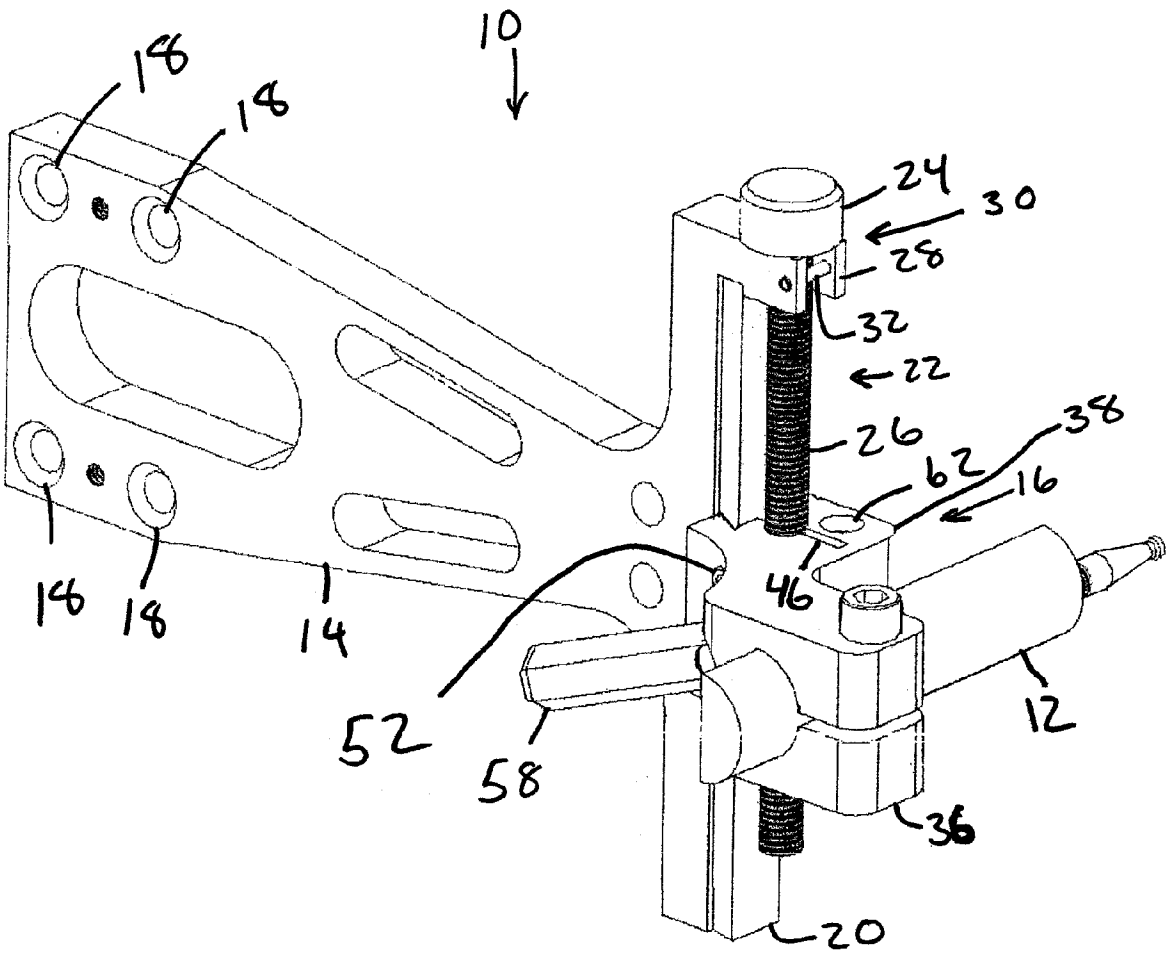
FIG. 1 is a front perspective view of a bow sight mount according to the present invention.
Figure 2:
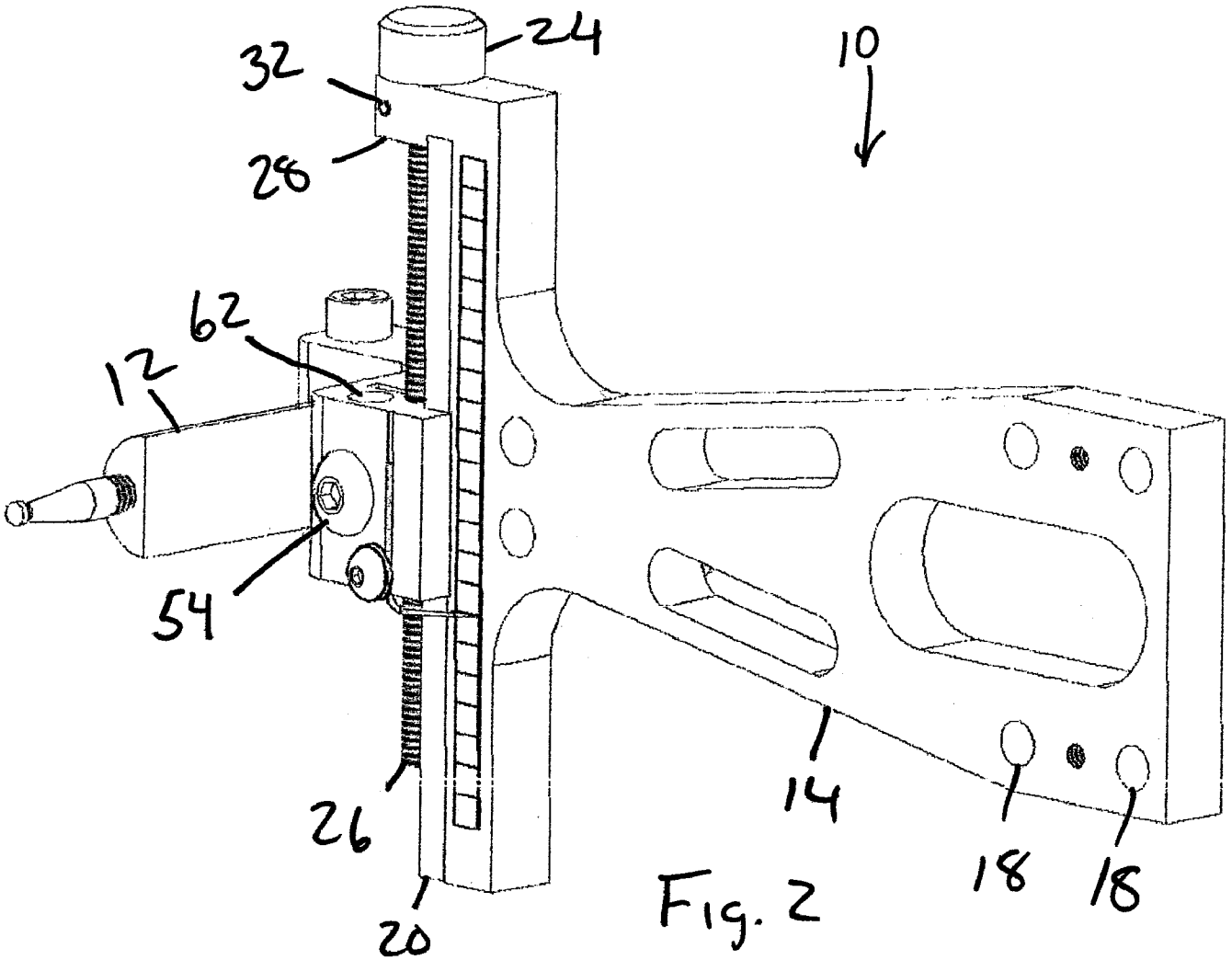
FIG. 2 is a rear perspective view of a bow sight mount according to the present invention.
Figure 3:
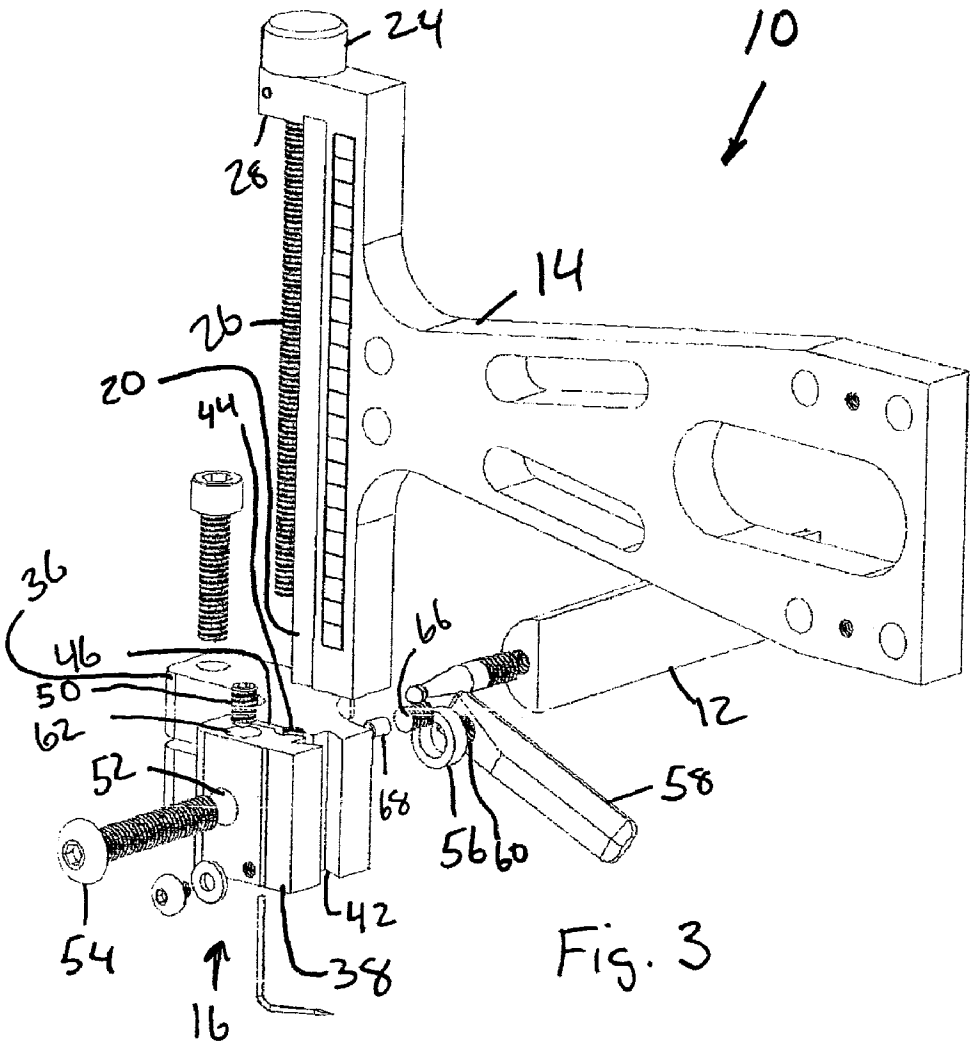
FIG. 3 is a rear perspective exploded view of a bow sight mount according to the present invention.
Figure 4:
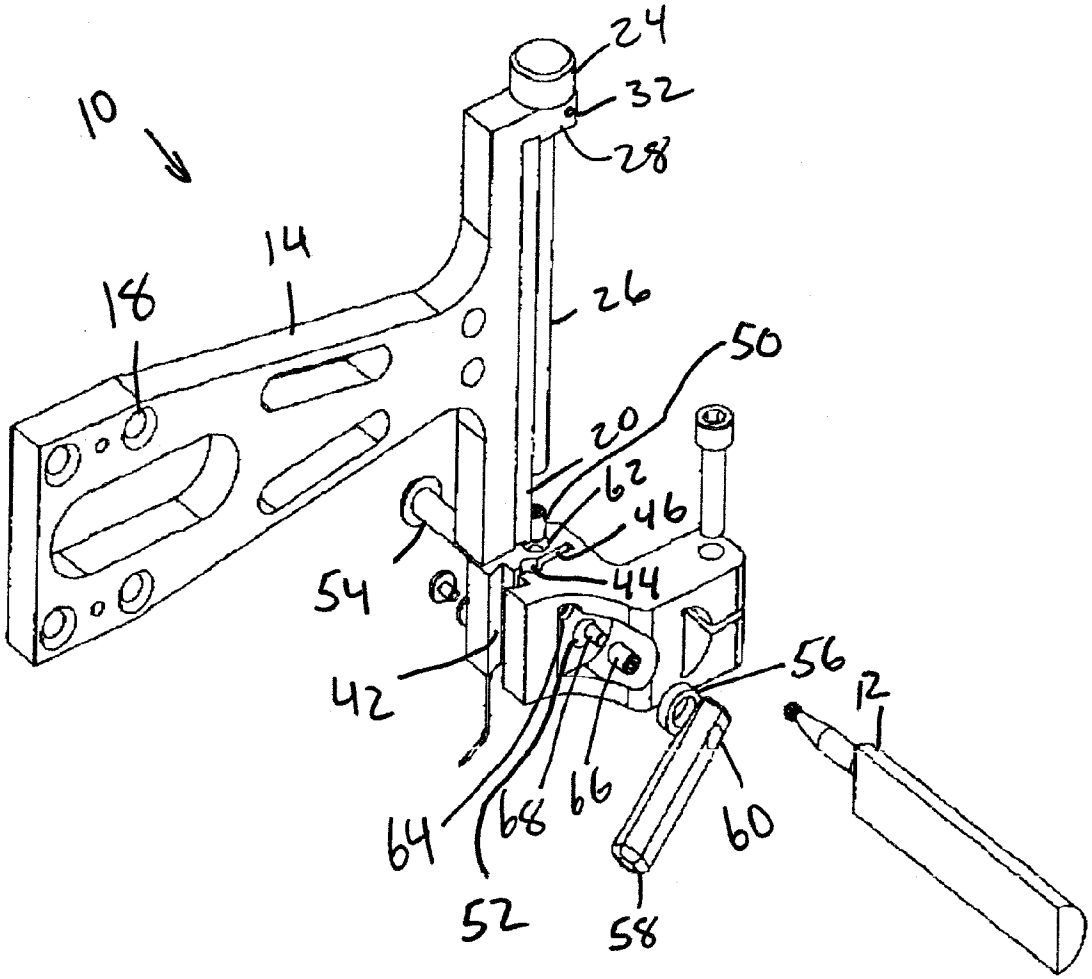
FIG. 4 is another rear perspective exploded view of a bow sight mount according to the present invention.
Figure 5:
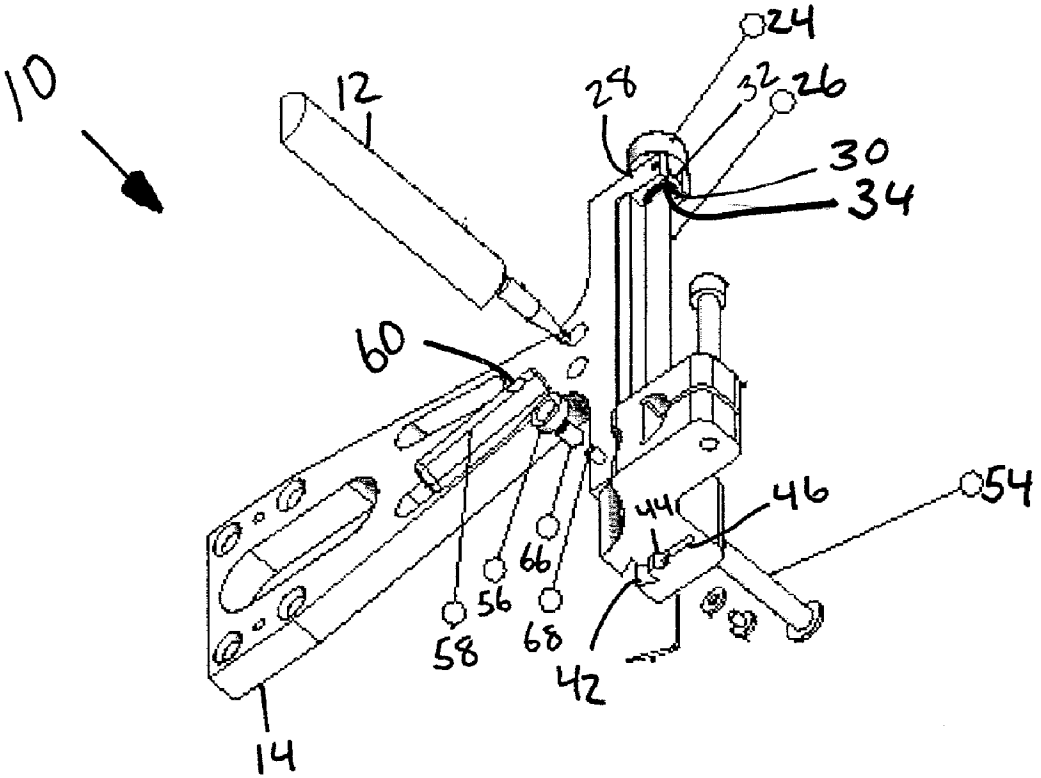
FIG. 5 is a lower perspective exploded view of a bow sight mount according to the present invention.

The present invention is a bow sight mount 10 for a bow sight 12, as shown in FIGS. 1–5. The bow sight mount 10 includes a mounting plate 14 and sight platform 16. The mounting plate 14 includes mounting holes 18 on a mounting end, slide rail 20 on a sight end and an adjustment bolt 22. The mounting holes 18 are for attachment of the mounting plate 14 to a bow. The slide rail 20 is a dovetail shaped rail along a sight end of the mounting plate 14. The adjustment bolt 22 includes a knob 24 and a threaded rod 26. The adjustment bolt 22 is rotatable attached forward of the slide rail 20 at the top of the mounting plate 14. The mounting plate 14 includes a bolt retainer 28 extending outward from the sight end of the mounting plate 14 at the top of the mounting plate 14. The bolt retainer 28 includes a slot 30 to receive a portion of the threaded rod 26 just below the knob 24. Whereby, the knob 24 rests on top of the bolt retainer 28 and the threaded rod 26 extends downward along the slide rail 20. A roll pin 32 is installed through the sides of the bolt retainer 28 and through the slot 30 to retain the adjustment bolt 22. The roll pin 32 is positioned such that the roll pin 32 traps the threaded rod 26 in the slot 30. Also, there is a retaining collar 34 attached to the threaded rod 26 below the bolt retainer 28 to prevent the removal of the adjustment bolt 22.

The sight platform 16 includes a sight section 36 and a slide section 38. The sight section 38 is configured to accept the mounting of the components of the bow sight 12. The slide section 38 extends from the sight section 36 and mounts to the slide rail 20 and threaded rod 26 of the mounting plate 14. The slide section 38 includes a dove-tail shaped rail groove 42, threaded adjustment bolt hole 44, clamping slot 46, tightening assembly, a handle bolt set screw 50 and an adjustment bolt lock assembly. The dovetail shaped rail groove 42 is positioned closest to the mounting plate 14 and is sized to receive the slide rail 20. The threaded adjustment bolt hole 44 is positioned forward of the dovetail shaped rail groove 42 to receive the threaded rod 26 of the adjustment bolt 22. The clamping slot 46 is a slot which extends and splits both the threaded adjustment bolt hole 44 and the dovetail shaped rail groove 42 in half. The clamping slot 46 then continues into part of the slide section 38. The slide section 38 includes a clamping hole 52 on the side of the slide section 38 and forward of the threaded adjustment bolt hole 44, in which the clamping slot 46 also splits. The tightening assembly includes a handle bolt 54, spacer 56 and handle 58. The handle bolt 54 is installed into the clamping hole 52 on one side of the sight slide section 38. The spacer 56 is installed over a portion of the handle bolt 54 which extends outward from the other side of the slide section 38. The handle 58 includes a threaded handle bolt hole 60 and the handle 58 is threaded onto the handle bolt 54. Above the installed handle bolt 54 and on one side of the clamping slot 46, there is a threaded handle bolt set screw hole 62 which travels all the way into the clamping hole 52 of the slide section 38. The handle bolt set screw 50 is installed into the threaded handle bolt set screw hole 62. On the side of the slide section 38, there is an adjustment bolt lock assembly set screw hole 64 in the slide section 38 just above the handle 58. The adjustment bolt lock assembly set screw hole 64 is aligned perpendicular with and leads to the threaded adjustment bolt hole 44. The adjustment bolt lock assembly set screw hole 64 allows access to the threaded rod 26. The adjustment bolt lock assembly includes a set screw 66 and a plug 68. The plug 68 is inserted into the threaded adjustment bolt lock assembly screw hole 64 and the set screw 66 is install into the adjustment bolt lock assembly screw hole 64 after the plug 68.

The bow sight mount 10 is mounted to a bow using the mounting holes 18 and fasteners. The sight platform 16 is attached by sliding the dovetail shaped rail groove 42 over the slide rail 20 and threading the threaded rod 26 into the threaded adjustment bolt hole 44. The slight platform 16 can then be adjusted along the mounting plate 14 by turning the knob 24 on the adjustment bolt 22. The handle bolt set screw 50 is then tighten against the handle bolt 54 to lock the handle bolt 54 in position. With the handle bolt 54 locked in position, the handle 58 can be rotated against the spacer 56 and the sight section 38 without rotating the handle bolt 54. Hence, rotation of the handle 58 squeezes the halves of the threaded adjustment bolt hole 44 and the sides of the dovetail shaped rail groove 42 along the clamping slot 46 to lock the sight platform 16 in place on the mounting plate 14. The adjustment bolt lock assembly acts a secondary lock to lock the sight platform 16 in position along the adjustment bolt 22 and slide rail 20 by preventing rotation of the threaded rod 26. By tightening the plug 68 in adjustment bolt lock assembly set screw hole 64 against the threads of the adjustment bolt 22 using the set screw 66, the adjustment bolt 22 is locked in place. The plug 68 can be made of a material which does not damage the threaded rod 26. Also the set screw 66 and plug 68 could be replace with a set screw of a non-marring material to protect the threaded rod 26.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention that is to be given the full breadth of any and all equivalents thereof.

What is claimed is:

1. A bow sight mount, comprising a mounting plate, said mounting plate including a sight end and a mounting end;

a rail extending along said sight end of said mounting plate;

an adjustment bolt retained by said sight end of said mounting plate;

sight platform, said sight platform including a slide section for connection to said sight end of said mounting plate, said sight platform including a sight section adapted for connection of a bow sight;

said slide section including a rail groove to slidably mount said slide sight platform to said rail of said sight end; said slide section including a threaded hole to receive threads of said adjustment bolt; said slide section including a clamping slot cut into said slide section which splits said rail groove to allow clamping of sides of said rail groove against said rail; and a tightening assembly to close and clamp said sides of said rail groove against said rail.

2. The bow sight mount of claim 1, wherein said tightening assembly includes a handle, a handle bolt and a clamping hole; wherein said clamping hole is in said sight section and passes through said clamping slot; wherein said handle bolt is positioned in said clamping hole; wherein said handle attaches to said handle bolt and can be turned to clamp said sides of said rail groove against said rail.

3. The bow sight mount of claim 2, wherein said slide section includes a threaded hole which leads to said handle bolt and further including a set screw which is screwed into said threaded hole which leads to said handle bolt and contacts said handle bolt to lock said handle bolt in position.

4. The bow sight mount of claim 3, wherein said slide section includes a threaded hole which leads to said adjustment bolt and further including a set screw which is screwed into said threaded hole which leads to said adjustment bolt and contacts said adjustment bolt to lock said adjustment bolt in position.

5. The bow sight mount of claim 3, wherein said clamping slot splits said threaded hole to receive threads of said adjustment bolt to allow clamping of halves of said threaded hole to receive threads of said adjustment bolt against said adjustment bolt and wherein said tightening assembly closes and clamps said halves of said threaded hole to receive threads of said adjustment bolt against said adjustment bolt.

6. The bow sight mount of claim 2, wherein said rail is a dove tail shape and said rail groove is a matching dove tail shape.

7. The bow sight mount of claim 2, wherein said clamping slot splits said threaded hole to receive threads of said adjustment bolt to allow clamping of halves of said threaded hole to receive threads of said adjustment bolt against said adjustment bolt and wherein said tightening assembly closes and clamps said halves of said threaded hole to receive threads of said adjustment bolt against said adjustment bolt.

8. The bow sight mount of claim 1, wherein said rail is a dove tail shape and said rail groove is a matching dove tail shape.

9. The bow sight mount of claim 8, wherein said slide section includes a threaded hole which leads to a handle bolt and further including a set screw which is screwed into said threaded bole which leads to said handle bolt and contacts said handle bolt to lock said handle bolt in position.

10. The bow sight mount of claim 1, wherein said rail runs in a vertical direction when in use on a bow, such that said sight section moves up and down said rail.

11. The bow sight mount of claim 1, wherein sight end includes a bolt retainer and wherein said bolt retainer includes a slot to receive said adjustment bolt and a pin to retain said adjustment bolt in said slot.

12. The bow sight mount of claim 11, wherein said slide section includes a threaded hole which leads to a handle bolt and further including a set screw which is screwed into said threaded hole which leads to said handle bolt and contacts said handle bolt to lock said handle bolt in position.

13. The bow sight mount of claim 1, wherein said adjustment bolt is forward of said rail towards said slide section.

14. The bow sight mount of claim 1, wherein said slide section includes a threaded hole which leads to said adjustment bolt and further including a set screw which is screwed into said threaded hole which leads to said adjustment bolt and contacts said adjustment bolt to lock said adjustment bolt in position.

15. The bow sight mount of claim 14, further including a plug positioned in said threaded hole which leads to said adjustment bolt before said set screw which is screwed into said threaded hole which leads to said adjustment bolt.

16. The bow sight mount of claim 14, wherein said clamping slot splits said threaded hole to receive threads of said adjustment bolt to allow clamping of halves of said threaded hole to receive threads of said adjustment bolt against said adjustment bolt and wherein said tightening assembly closes and clamps said halves of said threaded hole to receive threads of said adjustment bolt against said adjustment bolt.

17. The bow sight mount of claim 1, wherein said rail is a dove tail shape and said rail groove is a matching dove tail shape, wherein said rail runs in a vertical direction when in use on a bow, such that said sight section moves up and down said rail; wherein sight end includes a bolt retainer and wherein said bolt retainer includes a slot to receive said adjustment bolt and a pin to retain said adjustment bolt in said slot; and wherein said adjustment bolt is forward of said rail towards said slide section.

18. The bow sight mount of claim 17, wherein said slide section includes a threaded hole which leads to a handle bolt and further including a set screw which is screwed into said threaded hole which leads to said handle bolt and contacts said handle bolt to lock said handle bolt in position.

19. The bow sight mount of claim 18, wherein said slide section includes a threaded hole which leads to said adjustment bolt and further including a set screw which is screwed into said threaded hole which leads to said adjustment bolt and contacts said adjustment bolt to lock said adjustment bolt in position.

20. The bow sight mount of claim 17, wherein said slide section includes a threaded hole which leads to said adjustment bolt and further including a set screw which is screwed into said threaded hole which leads to said adjustment bolt and contacts said adjustment bolt to lock said adjustment bolt in position.

21. The bow sight mount of claim 1, wherein said clamping slot splits said threaded hole to receive threads of said adjustment bolt to allow clamping of halves of said threaded bole to receive threads of said adjustment bolt against said adjustment bolt and wherein said tightening assembly closes and clamps said halves of said threaded hole to receive threads of said adjustment bolt against said adjustment bolt.

* * * * *